US005145476A

United States Patent [19]

Chiarello

[11] Patent Number: 5,145,476

[45] Date of Patent: Sep. 8, 1992

[54] FOLDING STEPPER

[75] Inventor: Matt Chiarello, Browns, Ill.

[73] Assignee: Roadmaster Corporation, Olney, Ill.

[21] Appl. No.: 806,644

[22] Filed: Dec. 13, 1991

[51] Int. Cl.[5] ..... A63B 22/04

[52] U.S. Cl. ..... 482/53; 482/112

[58] Field of Search ..... 482/52, 53, 111, 112, 482/23, 57, 58, 142, 143, 144

[56] References Cited

U.S. PATENT DOCUMENTS

| | | | |
|---|---|---|---|
| 4,531,731 | 7/1985 | Law | 482/144 |
| 4,733,858 | 3/1988 | Lan | 482/53 |
| 4,838,543 | 5/1989 | Armstrong | 482/53 |
| 5,069,444 | 12/1991 | Wilkinson et al. | 482/52 |

OTHER PUBLICATIONS

Roadmaster Corporation Action Stepper Owner's Manual-Model 9390, dated Aug. 15, 1990

*Primary Examiner*—Stephen R. Crow

*Attorney, Agent, or Firm*—Polster, Lieder, Woodruff & Lucchesi

[57] ABSTRACT

A foldable stair climber exercise machine includes a central frame having a main support beam, a second support pivotally connected to the main support beam, and a cross-member pivotally connected to the second support and removably connected to the main support. Stepping members on opposite sides of the central frame are pivotally connected to the second support and are connected by a flexible linkage. Air cylinders are removably connected to the stepping members and pivotally connected to the frame. Because the frame members are easily disconnected and pivotal with respect to each other, and because the air cylinders are easily disconnected from the stepping members, the disclosed stair climber is easily folded to a flattened assemblage for storage.

11 Claims, 2 Drawing Sheets

FOLDING STEPPER

BACKGROUND OF THE INVENTION

This invention relates to exercise apparatus, and in particular to a foldable stair climbing exercise machine.

It is commonly known that stair climbing is good exercise. To make stair climbing more practical, manufacturers of exercise equipment have introduced stair climbing exercise equipment. The stair climbers are known to work the muscles of the thighs, calves, and buttocks muscles. This is shown in FIGS. 2–4, which show the stair climber of the present invention during use. When the exerciser keeps his feet flat, as shown in FIG. 2, the long thigh muscles are worked. When the lowered foot is raised, as shown in FIG. 3, the calve muscles are worked and if the exerciser bends at the waist while using the stair climber, as shown in FIG. 4, the buttocks muscles are worked.

Stair climbers, however, often take up a large amount of space. They are generally not foldable and thus are difficult to store, especially in small areas. These stair climbers thus take up extra space when not in use. Stair climbers which are foldable have had the step members positioned within a confining frame. Stair climbers having a pair of step members straddling a central frame have not been foldable.

SUMMARY OF THE INVENTION

One object of this invention is to provide a stair climbing exercise machine having step members on opposite sides of a central frame which may be folded so as to be stored when not in use.

Other objects will become apparent to those skilled in the art in light of the following disclosure and accompanying drawings.

In accordance with the invention, generally stated, a foldable exercise stair climbing machine is provided. The stair climber includes a support frame having a first support means, a second support means having an upper end portion pivotally connected to the first support means, and a cross member communicating between the first and second support means for holding a set position between the first and second support means. The cross-member is removably connected to one of the first and second support means and pivotally connected to the other. First and second step members are pivotally connected to the second support means and positioned on opposite sides of the support means. A flexible linkage extends between the first and second step members to produce equal and opposite pivotal movement of the first and second step members. Motion inhibitors are connected between the support frame and the step member means to inhibit downward motion of the step members. Upon disconnection of the cross member from one of the first and second support means, the first support means is pivotally moveable toward the second support means, whereby the first and second support means, the cross member, the step members and the motion inhibitors can all be folded together into a flattened assemblage.

DESCRIPTION OF THE PREFERRED EMBODIMENT

Figure 1:
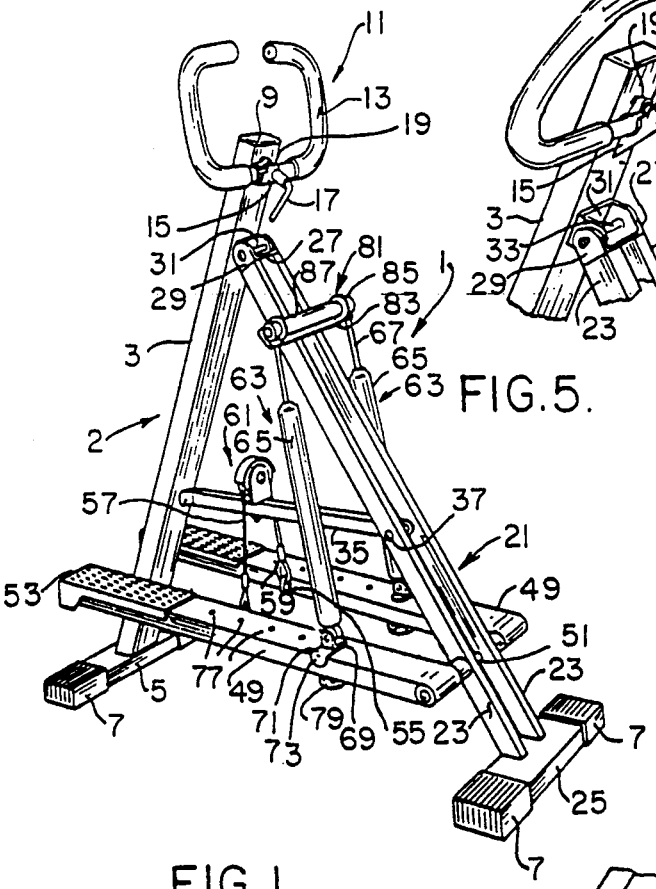
FIG. 1 is a perspective view of the stair climbing exercise apparatus of the present invention.
Figure 5:
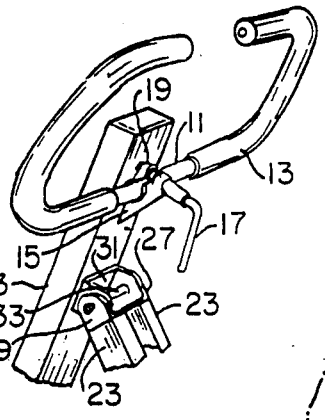
FIG. 5 is an enlarged, fragmentary perspective view showing the connection of a handlebar and buttress to a main support beam of the stair climber.

Referring to the Figures, a stair climber is generally indicated as 1. Stair climber 1 includes a frame 2 having a main beam 3, a buttress 21 and a girder 35.

Main beam 3 has a cross-member or foot 5 welded to the bottom thereof. Foot 5 is capped by rubber end pads 7. Beam 3 is hollow and is closed at its top by plastic end cap 9. A handle bar 11, the ends of which are enclosed by a foam grip, 13 is secured to main beam 3 a short distance from the top thereof. Handle bar 1 is held in a bracket 15 which is secured to main beam 3 by a threaded adjuster 17. Adjuster 17 does not extend through handle bars 11, but rather extends through ears 19 of bracket 15. Handle bars 11 and bracket 15 are both generally circular in cross-section. Thus, handle bar 11 may be pivoted in bracket 15 by loosening adjuster 17. When adjuster 17 is tightened, handle bar 11 is pivotally fixed in bracket 15.

A buttress 21 is pivotally attached to main beam 3. Buttress 21 is made of a pair of spaced, flat bars 23 which are welded to a cross-member or foot 25 at the bottoms thereof. The ends of foot 25 are covered by rubber end pads 7. The upper ends of bar 23 are welded to a generally C-shaped bracket 27 having ears 29 which are co-planar with bars 23. Bracket 27 receives a C-shaped bracket 31 which is secured to main beam 3. An axle 33 extends through the ears of brackets 27 and 31 to pivotally connect the brackets and hence to pivotally connect buttress 21 to main beam 3.

A girder 35 is sandwiched by, and pivotally connected to, bars 23 of buttress 21. An axle 37 extends through buttress 21 and girder 35 to pivotally connect them. The free end 35 of girder 35 has a pair of spaced ears 41 extending forwardly therefrom which are notched as at 43 to define hooks. A bracket 45 is connected to beam 3 and includes ears having outwardly extending pins 47. Hooks 43 capture pins 47 to removably connect girder 35 to main beam 3. Girder 35 secures main beam 3 and buttress 21 in a set position so that they will not pivot with respect to each other when stair climber 1 is in use.

A foot beam 49 is pivotally connected to the outside of each buttress bar 23. Foot beams 49 are mounted on an axle 51 which extends between and beyond beams 23. Foot beams 49 extend rearwardly from buttress 21 slightly beyond main beam 3. Main beam 3 and buttress 21 extend upwardly between foot beams 49. Because the frame extends upwardly between the foot beams, the frame will not hinder an exerciser E while stair climber 1 is being used. The free end of each foot beam 49 is covered by a foot pad 53. Pads 53 have treads which provide traction so that a user will not slip off stair climber 1 while exercising.

Figure 2:
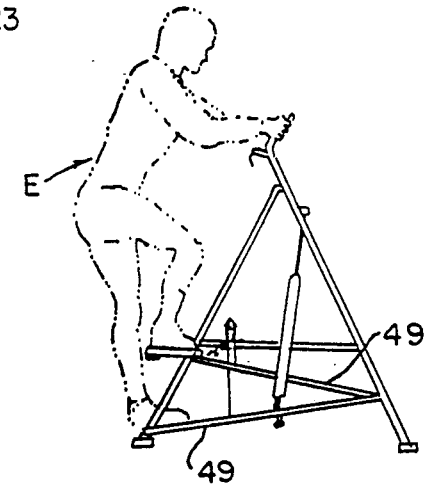
FIGS. 2–4 show the exercise apparatus in use.
Figure 6:
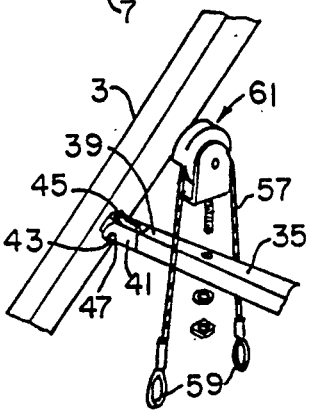
FIG. 6 is an enlarged, fragmentary perspective view showing a girder with a pulley assembly.
Figure 3:
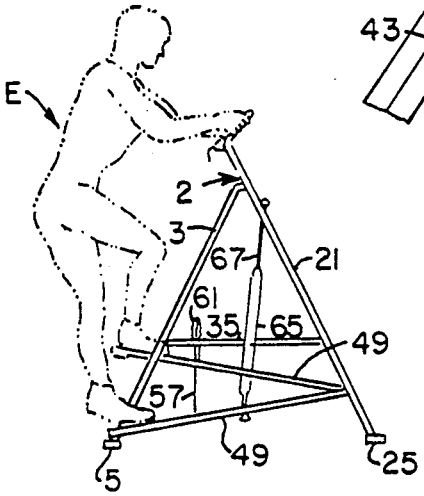
Figure 4:
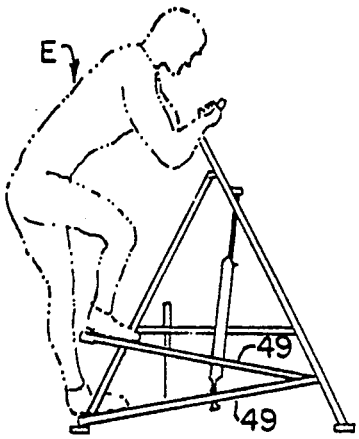

Each foot beam 49 has a hook 55 secured to an inner edge thereof approximately at the middle of the foot beam. A flexible cable 57 extends over a pulley assembly 61 mounted on girder 35 and connects the two foot beams 49. Pulley assembly 61 is rotatably attached to girder 35 to rotate between a position in which the pulley is parallel to girder 35 and a position in which it is perpendicular to girder 35. Cable 57 has loops 58 which are removably attached to hooks 55. As shown in FIGS. 2–4, cable 57 produces equal and opposite pivotal movement in the foot beams. In FIG. 2, exerciser E has his right foot elevated and his left foot down. When he steps, as shown in FIG. 3, the left foot is elevated to the same height as the right foot was and the right foot is lowered. The foot positions are then reversed again in FIG. 4 when exerciser E climbs another step.

An air cylinder 63 is removably attached to each of the foot beams 49. Each air cylinder 63 includes a cylinder 65. A piston 67 is housed in cylinder 65 to be extendable and retractable into and out of cylinder 65. Cylinder 65 is pivotally attached to a "C" shaped bracket 69, which in turn is connected to an angle bracket 71. Bracket 71 has a lip 73 and a threaded bolt 75 which extends downwardly from bracket 71. A plurality of bolt holes 77 extend through foot beam 49. Bolt 75 extends through a selected bolt hole 77 and a knob 79 is threaded to bolt 75 beneath foot beam 49 to removably connect cylinder 65 to foot beam 49.

An elongate bracket 81 has a base 83 which is secured to buttress 21. Base B3 has upwardly extending ears 85 through which an axle 87 is journaled. Air cylinder pistons 67 are secured to axle 87 so as to be pivotable with respect to buttress 21.

Air cylinder 63 and cable 57 essentially support the exerciser and must be strong enough to do so. The air cylinders 63 inhibit the pivotal motion of foot beams 49. The difficulty of a workout may be changed by changing the bolt hole 77 through which the air cylinder 63 is connected. The two air cylinders are generally secured to matching bolt holes, i.e., the end bolt hole of each foot beam 49.

Figure 8:
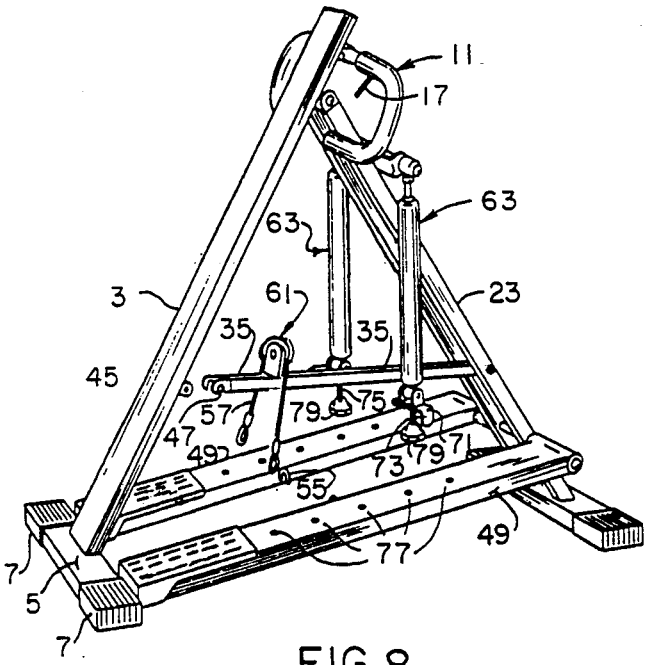
FIG. 8 shows an air cylinder tube being removed from a foot beam.
Figure 9:
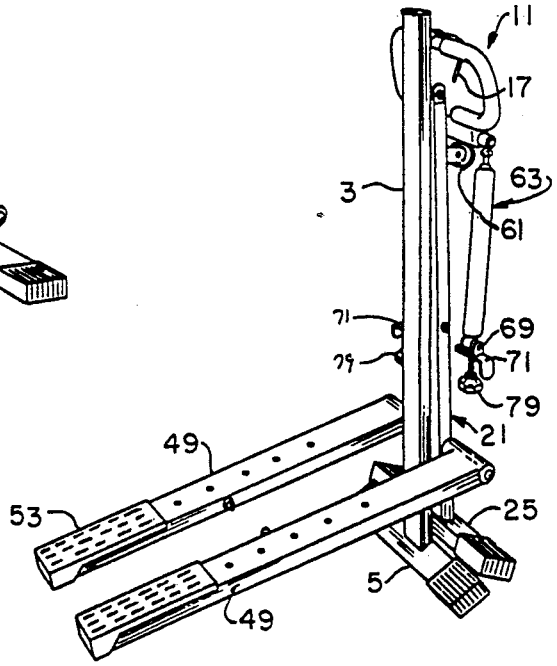
FIG. 9 shows the stair climber partly folded.
Figure 7:
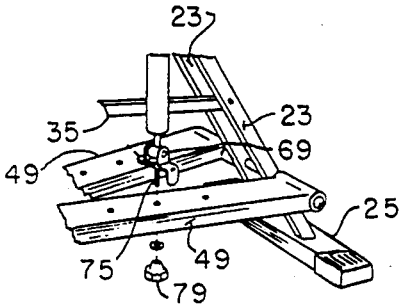
FIG. 7 is a perspective view of the stair climber being readied for folding.

To fold the stair climber 1, air cylinders 63 are removed from foot beams 49 by unscrewing knobs 79 from bolt 75. Cable 57 is removed from foot beam hooks 55 and girder 35 is removed from bracket 45 of main beam 3. Pulley assembly 61 is rotated in girder 35 to be parallel thereto. Girder 35 is then pivoted upwardly to be sandwiched by buttress bars 23. In this position, pulley assembly 61 extends through bars 23. Main beam 3 and buttress 21 are pivoted and brought together, as is shown in FIG. 7. At this point, foot beams 49 extend beyond main beam 3 Main beam 3 and buttress 21 are then pivoted downwardly to lie over foot beams 49. When folded like this, stair climber 1 occupies a minimal amount of space and can be easily stored. To further reduce the size of the folded stair climber, handle bar 11 may be loosened using adjuster 17 and folded over foot beams 49, as is shown in FIGS. 7–9.

Figure 10:
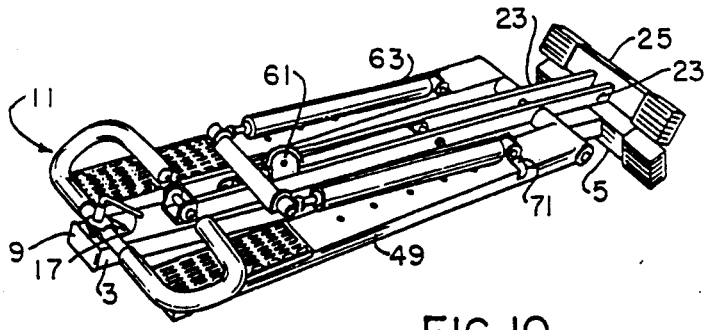
FIG. 10 shows the stair climber when fully folded.

As is shown in FIG. 10, when the cylinders 63 are bolted into the bolt hole 77 farthest from the foot pads 53, stair climber 1 may be folded without disconnecting cylinders 63 from foot beams 49. Climber 1 may also be folded without removing the cord 57 from foot beams 49. The described structure thus presents a stair climber which is easily folded to a flattened assembly which may be stored in a small space.

In view of the above, it will be seen that the various objects and features of this invention are achieved and other advantageous results obtained. As various changes could be made in the above constructions without departing from the scope of the invention, it is intended that all matter contained in the above description or shown in the accompanying drawing shall be interpreted as illustrative and not in a limiting sense.

What is claimed is:

1. A foldable exercise stair climbing machine comprising:

a support frame having first support means including a lower end portion adapted to rest upon a horizontal surface;

second support means having a lower end portion adapted to rest upon such surface at a point spaced from said first support means, said second support means having an upper end portion pivotally connected to said first support means;

cross-member means communicating between said first and second support means for holding a set position between said first and second support means, said cross-member means being removably connected to one of said first and second support means;

first and second step members pivotally connected to said second support means and positioned on opposite sides of said first and second support means;

flexible linkage means communicating between said first and second step members for producing equal and opposite pivotal movement of said first and second step members; and motion inhibiting means connected between said support frame and said step member means for inhibiting downward motion of said step members;

said first support means being pivotally moveable toward said second support means upon disconnection of said cross member means from at least one of said first and second support means;

whereby said first and second support means, said cross member means, said step members and said motion inhibiting means can all be folded together into a flattened assemblage.

2. The stair climbing machine as specified in claim 1 wherein said first support means being positioned between said first and said second step members.

3. The stair climbing machine as specified in claim 2 wherein said second support means being positioned between said first and said second step members.

4. The stair climbing machine as specified in claim 1 and wherein said motion inhibiting means is removably connected to said step members.

5. The stair climbing machine as specified in claim 4 wherein said linkage means is removably connected to said step members.

6. The stair climbing machine as specified in claim 5 wherein said linkage means extends over a pulley assembly mounted on said cross-member means, said pulley assembly being pivotal with respect to said cross-member means between a position wherein said pulley assembly is perpendicular to said cross-member means and a position wherein said pulley assembly is parallel to said cross-member means.

7. The stair climbing machine as specified in claim 6 wherein said second support means includes a pair of spaced bars, said cross-member means being received between said spaced bars when said stair climbing machine is folded.

8. A method of folding a stair climbing exercise machine, said stair climbing exercise machine including a main support beam, a second support beam pivotally connected to said main support beam, a cross-member pivotally connected to one of said first and second support beams and removably connected to the other of said first and second support beams, stepping members on opposite sides of said main and second support beams pivotally connected to said second support beam and, flexible linkage means removably connected to said stepping members, motion inhibitors pivotally connected to one of said frame and said step members and removably connected to the other of said frame and said step members; said method including the steps of:

disconnecting said cross-member from one of said first and second support means;

pivoting said first and second support beams with respect to each other so as to bring said first and second support beams together; and pivoting said first and second support beams with respect to said stepping members so as to fold said stair climbing machine into a flattened assemblage.

9. The method of claim 8 further including a step of disconnecting said motion inhibitors from one of said stepper members and said frame;

10. The method as set forth in claim 8 further including a step of disconnecting said linkage means from said stepping members.

11. The method as set forth in claim 9 wherein said stair climbing machine further includes handle bars pivotably mounted on said first support beam, the method further including a step of pivoting said handlebars downwardly so as to lie over said stepping members.

* * * * *